US007506496B2

(12) United States Patent
Mantchenkov et al.

(10) Patent No.: US 7,506,496 B2
(45) Date of Patent: Mar. 24, 2009

(54) EFFERVESCENT AERODYNAMIC SYSTEM FOR INJECTING AN AIR/FUEL MIXTURE INTO A TURBOMACHINE COMBUSTION CHAMBER

(75) Inventors: Igor Mantchenkov, Moscow (RU); Thomas Noel, Paris (FR); Alexander Novikov, Moscow (RU); Vladimir Orlov, Moscow (RU); Valery Pikalov, Moscow (RU); Gilles Rollin, Blandy les Tours (FR)

(73) Assignee: Snecma, Paris (FR)

( * ) Notice: Subject to any disclaimer, the term of this patent is extended or adjusted under 35 U.S.C. 154(b) by 560 days.

(21) Appl. No.: 11/230,640

(22) Filed: Sep. 21, 2005

(65) Prior Publication Data

US 2006/0059914 A1 Mar. 23, 2006

(30) Foreign Application Priority Data

Sep. 23, 2004 (FR) ..... 04 10052

(51) Int. Cl.
*F23R 3/28* (2006.01)

(52) U.S. Cl. ..... 60/39.461; 60/737; 60/740

(58) Field of Classification Search ..... 60/39.461, 60/39.463, 39.49, 737, 738, 740; 44/628
See application file for complete search history.

(56) References Cited

U.S. PATENT DOCUMENTS

| | | | | |
|---|---|---|---|---|
| 3,937,011 | A * | 2/1976 | Caruel et al. | 60/737 |
| 4,189,914 | A * | 2/1980 | Marek et al. | 60/737 |
| 4,443,180 | A * | 4/1984 | LeFrois | 431/4 |
| 6,128,894 | A * | 10/2000 | Joos et al. | 60/737 |

FOREIGN PATENT DOCUMENTS

| | | |
|---|---|---|
| EP | 0 119 086 A2 | 9/1984 |
| EP | 0 458 685 A1 | 11/1991 |
| EP | 1 314 933 A1 | 5/2003 |
| EP | 1 331 441 A1 | 7/2003 |
| WO | WO 99/30831 | 6/1999 |

* cited by examiner

*Primary Examiner*—Louis J Casaregola
(74) *Attorney, Agent, or Firm*—Oblon, Spivak, McClelland, Maier & Neustadt, P.C.

(57) ABSTRACT

An aerodynamic injection system for injecting an air/fuel mixture into a turbomachine combustion chamber comprises a tubular structure of axis XX' that opens out at a downstream end for delivering the air/fuel mixture, at least one air feed channel that opens out into the structure so as to introduce air at a pressure $P_A$ therein, an annular fuel passage that is formed in the structure around its axis XX', that is connected to at least one fuel feed channel in which there flows fuel at a pressure $P_C$, and that opens out at a downstream end into the structure, and means for injecting gas into the at least one fuel feed channel, said gas being at a pressure $P_G$ that is greater than $P_A$ and greater than or equal to $P_C$ so as to create effervescence in the fuel on being introduced into the structure.

17 Claims, 2 Drawing Sheets

EFFERVESCENT AERODYNAMIC SYSTEM FOR INJECTING AN AIR/FUEL MIXTURE INTO A TURBOMACHINE COMBUSTION CHAMBER

BACKGROUND OF THE INVENTION

The present invention relates to the general field of systems for injecting an air/fuel mixture into a turbomachine combustion chamber. More particularly, it relates to an injection system of the aerodynamic type provided with means for creating effervescence in the fuel prior to it being mixed with air.

The conventional process for designing and optimizing a turbomachine combustion chamber seeks mainly to reconcile implementing operational performance of the chamber (combustion efficiency, stability domain, ignition and re-ignition domain, lifetime of the combustion area, etc.) as a function of the intended mission for the airplane on which the turbomachine is mounted while minimizing emissions of pollution (nitrogen oxides, carbon monoxide, unburnt hydrocarbons, etc.). To do this, it is possible in particular to act on the nature and the performance of the injection system for injecting the air/fuel mixture into the combustion chamber, on the distribution of dilution air inside the combustion chamber, and on the dynamics of air/fuel mixing within the combustion chamber.

The combustion chamber of a turbomachine typically comprises an injection system for injecting an air/fuel mixture into a flame tube, a cooling system, and a dilution system. Combustion takes place mainly within a first portion of the flame tube (referred to as the "primary zone") in which combustion is stabilized by means of air/fuel mixture recirculation zones induced by the flow of air coming from the injection system. In the second portion of the mixer tube (referred to as the "dilution zone"), the chemical activity that takes place is less intense and the flow is diluted by means of dilution holes.

In the primary zone of the flame tube, various physical phenomena are involved: injection and atomization into fine droplets of the fuel, evaporation of the droplets, mixing of the fuel vapor with air, and chemical reactions of the fuel being oxidized by means of the oxygen in the air.

These physical phenomena are governed by characteristic times. Atomization time thus represents the time needed by the air to disintegrate the sheet of fuel to form an air/fuel spray. It depends mainly on the performance and the technology of the injection system used and on the aerodynamics in the vicinity of the sheet of fuel. Evaporation time also depends on the injection system used. It is a function directly of the size of the droplets resulting from the disintegration of the sheet of fuel; the smaller the droplets, the shorter the evaporation time. Mixing time corresponds to the time needed for the fuel vapor coming from the evaporation of the droplets to mix with the air. It depends mainly on the level of turbulence inside the combustion area, and thus on the flow dynamics in the primary zone. Chemical time represents the time needed for the chemical reactions to develop. It depends on the pressures and temperatures at the inlet to the combustion area and on the nature of the fuel used.

The injection system used thus plays a fundamental role in the process of designing a combustion chamber, in particular when optimizing the times that are characteristic of fuel atomization and evaporation.

There exist two main families of injection systems: "aero-mechanical" systems in which the fuel is atomized as a result of a large pressure difference between the fuel and the air; and "aerodynamic" systems in which the fuel is atomized by being sheared between two sheets of air. The present invention relates more particularly to such aerodynamic systems.

Aerodynamic injection systems known in the prior art present numerous drawbacks. In particular, at low turbomachine speeds, fuel atomization becomes highly degraded, thereby decreasing the stability of combustion and running the risk of the combustion area going out while also increasing polluting emissions of the nitrogen oxide type.

OBJECT AND SUMMARY OF THE INVENTION

A main aim of the present invention is thus to mitigate those drawbacks by proposing an aerodynamic injection system that enables the times characteristic of fuel atomization and evaporation to be shortened at all operating speeds of the turbomachine.

To this end, the invention provides an aerodynamic injection system for injecting an air/fuel mixture into a turbomachine combustion chamber, the system comprising: a tubular structure of axis XX' that opens out at a downstream end for delivering the air/fuel mixture; at least one air feed channel that is connected to a compressor stage of the turbomachine and that opens out into the tubular structure in such a manner as to introduce air at a pressure $P_A$ into the tubular structure; and an annular fuel passage that is formed in the tubular structure around its axis XX', that is connected to at least one fuel feed channel in which fuel flows at a pressure $P_C$, and that opens out at a downstream end into the tubular structure, forming an enlargement therein; the system further comprising means for injecting gas into the at least one fuel feed channel, the gas being at a pressure $P_G$ that is greater than the pressure $P_A$ and greater than or equal to $P_C$ so as to create effervescence in the fuel on being introduced into the tubular structure.

By injecting gas into the fuel duct at a pressure that is greater than or equal to the pressure of the fuel, liquid/gas mixing is caused to take place at the pressure $P_C$ prior to the fuel being introduced into the main structure in which it is dispersed. During the expansion of this mixture from the pressure $P_C$ to the internal pressure in the main structure, the sudden expansion of the gaseous phase causes the sheet of fuel to disintegrate: this is effervescence. As a result, the times characteristic of the fuel atomization and evaporation at the outlet from the injection system can be considerably reduced.

These shortenings of time thus make it possible at slow operating speeds of the turbomachine to increase combustion efficiency and to increase the ability of the combustion area to avoid going out, while at full-throttle speed of turbomachine operation, they enable the formation of polluting emissions of the nitrogen oxide and soot types to be limited.

More particularly, the injection system includes at least one gas injection channel that opens out into the fuel feed channel(s) and that is connected to a gas feed duct.

Advantageously, the gas injection channel opens out substantially perpendicularly into the fuel feed channel(s).

The injection system may comprise an annular gas distribution cavity that is formed in the tubular structure around the fuel passage, that is connected to the gas feed duct, and that opens out into the gas injection channel.

The injection system may also include an annular fuel distribution cavity that is formed in the tubular structure, that is connected to a fuel feed duct, and that opens out into the fuel feed channel.

In an embodiment of the invention, the air feed channel opens out into the tubular structure at an upstream end thereof. The injection system may include an outer air swirler that is disposed around the tubular structure, that is offset radially relative to the fuel passage, and that serves to inject air at the outlet from the tubular structure along a direction that is substantially axial. The outer air swirler may be connected to a compressor stage of the turbomachine, and a bowl that forms a divergent portion may be mounted downstream from the tubular structure.

In another embodiment of the invention, the air feed channel is disposed around the tubular structure and opens out axially into the fuel passage at an upstream end thereof. The annular fuel passage may present a narrowing of section in the fuel flow direction in order to accelerate the flow of fuel through the tubular structure.

According to an advantageous characteristic of the invention, the gas used is air which is preferably taken from a compressor stage of the turbomachine prior to being compressed.

According to another advantageous characteristic of the invention, a device is provided for controlling the flow rate of the gas injected into the fuel feed channel.

BRIEF DESCRIPTION OF THE DRAWINGS

Other characteristics and advantages of the present invention appear from the following description made with reference to the accompanying drawings which show an embodiment that has no limiting character. In the figures.

DETAILED DESCRIPTION OF AN EMBODIMENT

Figure 1:
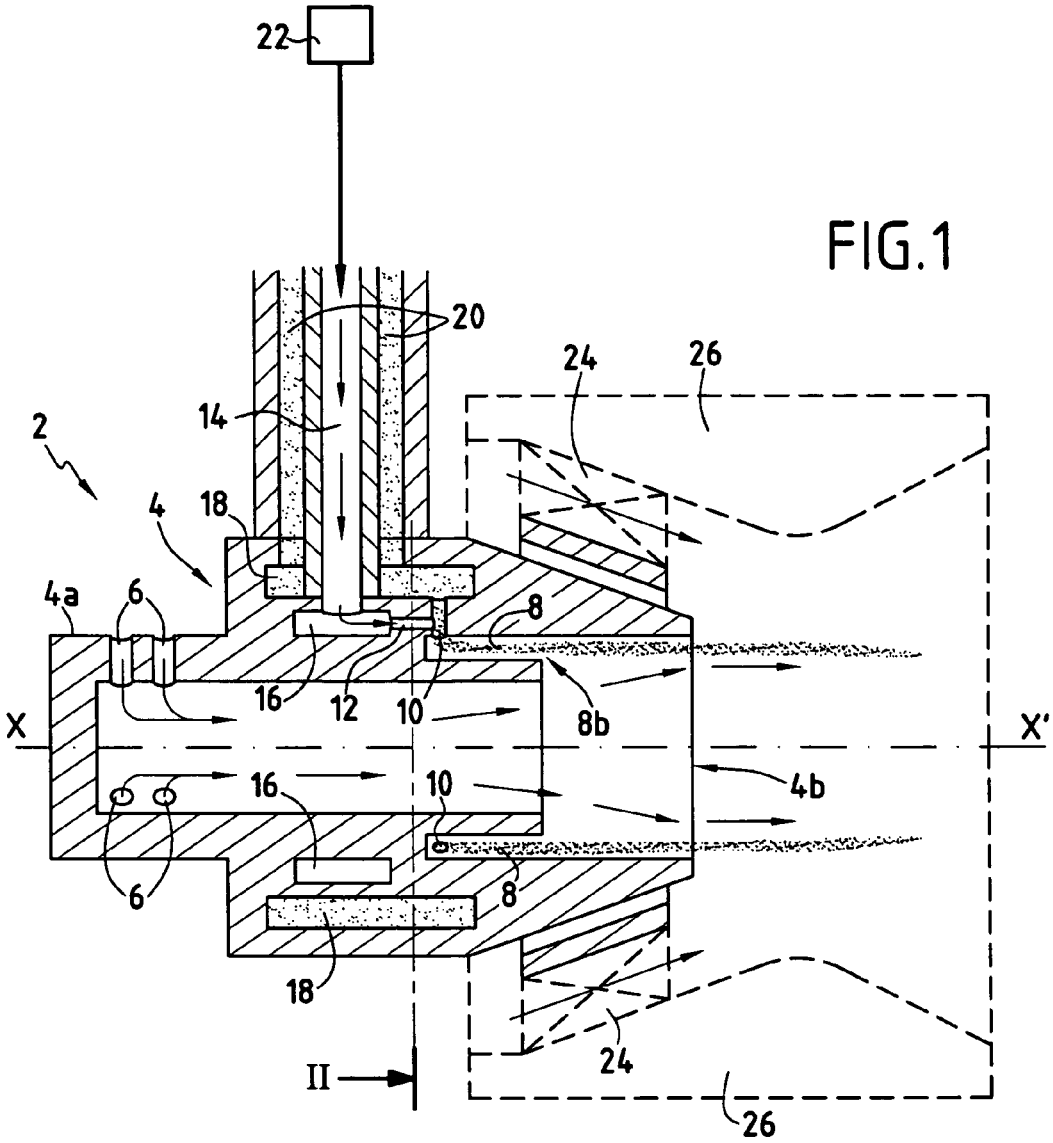
FIG. 1 is an axial section view of an injection system constituting an embodiment of the invention.
Figure 3:
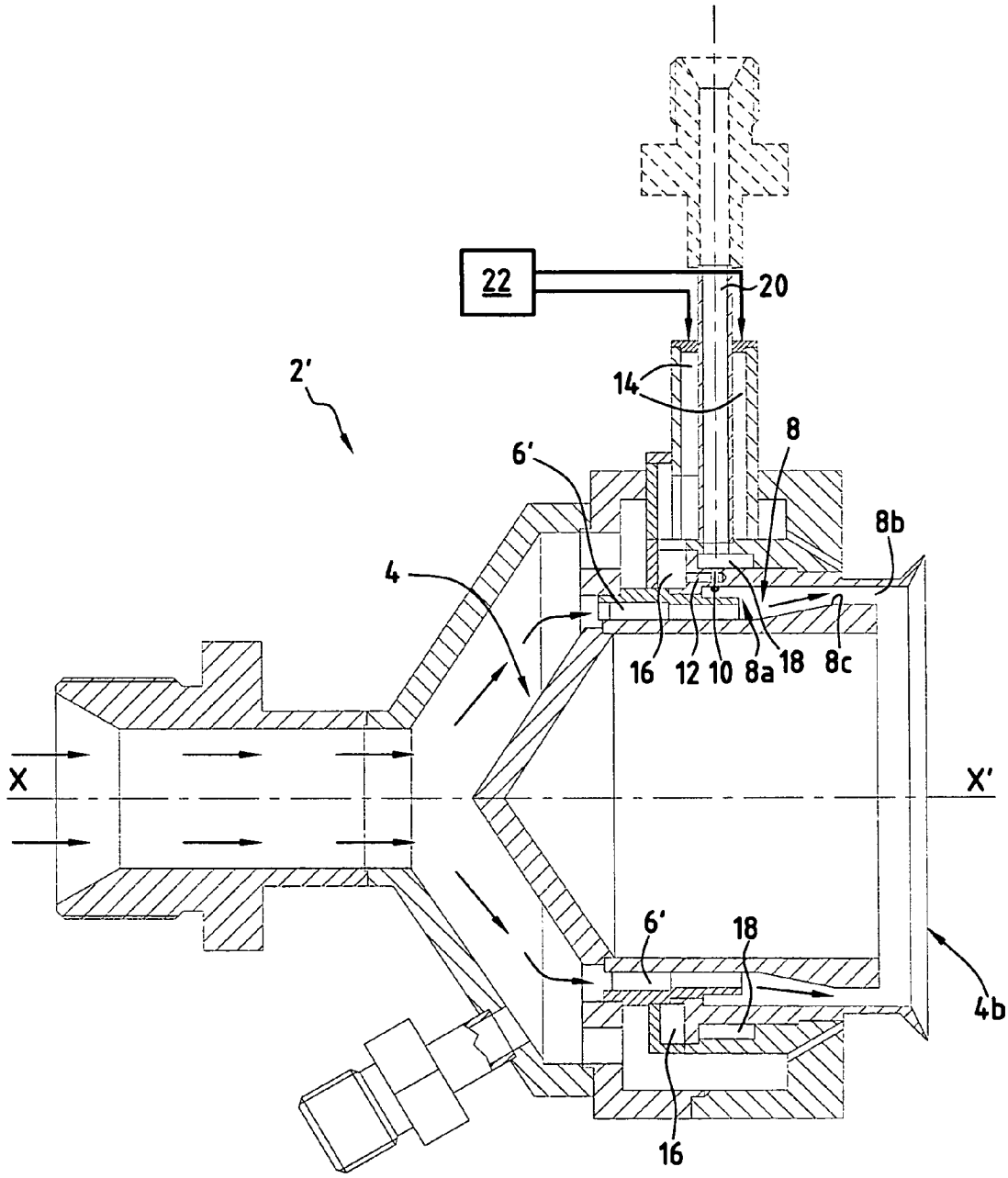
FIG. 3 is an axial section view of an injection system in another embodiment of the invention.

With reference to FIGS. 1 and 3, the aerodynamic injection system 2, 2' of the invention is generally in the form of a tubular structure 4 of axis XX' that is open at its downstream end 4*b* for delivering the air/fuel mixture.

The injection system 2, 2' includes at least one air/feed channel 6, 6' that is connected to a compressor stage (not shown) of the turbomachine and that opens out into the tubular structure 4. Air is thus introduced into the tubular structure 4 via said channel(s) 6, 6' at a pressure $P_A$, e.g. of the order of 0.5 to 50 bar.

The injection system 2, 2' also includes an annular fuel passage 8 that is formed in the tubular structure about its axis XX'. The downstream end 8*b* of the fuel passage 8 opens out into the tubular structure 4 and forms a sudden enlargement therein.

The fuel passage 8, which is centered on the axis XX' of the tubular structure 4, is connected to at least one fuel feed channel 10 having fuel flowing therein at a pressure $P_C$. The passage 8 enables fuel to be introduced into the tubular structure 4 along the axial direction XX'. By way of example, the pressure $P_C$ of the fuel flowing in the fuel feed channel 10 is about 4 bar to 80 bar.

Figure 2:
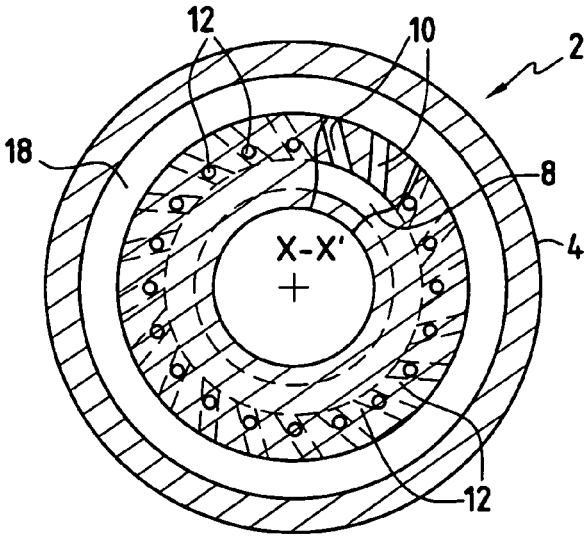
FIG. 2 is a partially cutaway section view on II-II of FIG. 1.

As shown in FIG. 2, the annular fuel passage 8 may be connected, by way of example, to twenty fuel feed channels 10 that are regularly distributed over the entire circumference of the tubular structure 4 so as to obtain a uniform distribution of fuel in the passage 8.

The fuel feed channels 10 are preferably inclined tangentially relative to the annular fuel passage 8, e.g. an angle of abut 45° (FIG. 2). As a result, the fuel is set into rotation on being introduced into the passage 8.

According to the invention, the injection system 2, 2' further comprises at least one gas injection channel 12 that opens out into the fuel feed channels 10 and that is connected to a gas feed duct 14.

As shown in FIG. 2, a gas injection channel 12 may be provided for each fuel injection channel 10. In the embodiment of FIG. 2, the injection system 2 thus has twenty gas injection channels 12 distributed around the circumference of the tubular structure 4. Alternatively, it is also possible to provide fewer gas injection channels than fuel feed channels.

Still according to the invention, the gas is introduced into the fuel feed channel(s) at a pressure $P_G$ that is greater than the pressure $P_A$ of the air introduced into the tubular structure 4 via the air feed channel(s) 6, 6', and that is greater than or approximately equal to the pressure $P_C$ of the fuel flowing in the fuel feed channel(s) 10.

Introducing gas into the fuel feed channel(s) 10 at a pressure $P_G$ greater than the pressure $P_A$ and greater than or equal to the pressure $P_C$ serves to create a liquid/gas mixture at the pressure $P_C$ prior to the mixture being introduced into the tubular structure 4. Effervescence in the fuel is characterized by the fuel being atomized due to the gas expanding suddenly on being introduced into the tubular structure 4.

More particularly, effervescence takes place in the fuel when the following conditions are satisfied: the gas is at a pressure $P_G$ that is substantially equal to the pressure $P_C$ of the fuel (or at a pressure that is slightly greater), and the mixing of the gas with the fuel takes place in a space that is substantially confined (specifically mixing takes place in the zone of confluence between the gas injection channels 12 and the fuel feed channels 10).

Effervescence in the fuel is characterized by the presence of bubbles of gas in the sheet of fuel that flows in the fuel passage 8. The expansion of the gas bubbles during introduction of the mixture into the tubular structure 4 thus facilitates subsequent atomization thereof. The times characteristic of fuel atomization and evaporation are thus shortened.

The gas is preferably an inert gas that has no direct influence on the combustion of the air/fuel mixture. For example, the gas is air that is taken from a compressor stage of the turbomachine and that is further compressed in order to reach a pressure $P_G$ greater than the pressure $P_A$ of the air feeding the air feed channel(s) 6, 6'.

According to an advantageous characteristic of the invention, the gas injection channel(s) 12 opens out substantially perpendicularly into the fuel feed channel(s) 10. This particular arrangement serves to encourage the appearance of effervescence in the fuel.

An annular gas cavity 16 may be formed in the tubular structure 4 around the fuel passage 8. Such a gas cavity 16 is centered on the axis XX' of the tubular structure 4 so as to be coaxial with the fuel passage 8. It is connected to the gas feed duct 14 and opens out into the gas injection channel(s) 12. This gas cavity 16 thus acts as a gas distribution cavity.

Similarly, an annular fuel cavity 18 may be formed in the tubular structure 4. As shown in the figures, this fuel cavity 18 is also centered on the axis XX' of the tubular structure 4 so as to be coaxial with the fuel passage 8 and the gas cavity 16. It is connected to a fuel feed duct 20 and opens out into the fuel duct channel(s) 10. This fuel cavity 18 thus acts as a fuel distribution cavity.

According to another advantageous characteristic of the invention, the injection system 2, 2' further comprises a device 22 for controlling the flow rate of the gas injected into the fuel feed channel 10. Such a device 22 thus serves to control the flow rate of the gas needed for injection in order to achieve effervescence in the fuel. For example, the gas flow rate may be controlled as a function of the flow rate and the pressure $P_C$ of the fuel.

Particular features of the embodiment of the injection system 2 of the invention as shown in FIGS. 1 and 2 are described below.

In this embodiment, the injection system 2 may have two rows of air feed channels 6 that are axially spaced apart from each other and that are regularly distributed around the entire circumference of the tubular structure 4. These channels 6 may open out into the upstream end 4*a* of the tubular structure 4.

The air introduced via the channel(s) 6 at a pressure $P_A$ thus flows in the tubular structure 4 in the axial direction XX' to the downstream end 4*b* of the structure accompanied by a rotational effect inside the tubular structure 4.

Furthermore, the injection system 2 preferably includes an outer air swirler 24 that is disposed around the tubular structure 4 and that is radially offset relative to the fuel passage 8. This outer air swirler 24 serves to inject air at the outlet of the tubular structure 4 in a direction that is substantially axial and likewise accompanied by a rotary effect. Thus, the effervescent fuel that is introduced into the tubular structure 4 via the fuel passage 8 is atomized by the effect of the shear between the air coming from the air speed channel 6 and from the outer air swirler 24.

The air feeding the outer air swirler 24 is preferably taken from a compressor stage of the turbomachine, e.g. from the same stage as the air that is introduced into the tubular structure 4 via the air feed channel(s) 6. In addition, still in this embodiment of the invention, a bowl 26 forming a diverging portion can be mounted downstream from the tubular structure 4.

The particular features of the embodiment of the injection system 2' shown in FIG. 3 are described below.

In this embodiment, the injection system 2' has a single air feed channel 6'. This channel is annular; it is placed around the tubular structure 4 and opens out axially into the fuel passage 8 at an upstream end 8*a* thereof. The air introduced via the channel 6' at a pressure $P_A$ thus flows in the fuel passage 8 prior to being introduced into the tubular structure 4 via an enlargement thereof.

Furthermore, the fuel passage 8 preferably presents a narrowing of section 8*c* in the fuel flow direction in order to accelerate the flow of fuel in the tubular structure 4.

What is claimed is:

1. An aerodynamic injection system for injecting an air/fuel mixture into a turbomachine combustion chamber, the system comprising:

a tubular structure of axis XX' that opens out at a downstream end for delivering the air/fuel mixture;

at least one air feed channel that is connected to a compressor stage of the turbomachine and that opens out into the tubular structure in such a manner as to introduce air at a pressure PA into the tubular structure;

an annular fuel passage that is formed in the tubular structure around its axis XX', that is connected to at least one fuel feed channel in which fuel flows at a pressure PC, and that opens out at a downstream end into the tubular structure, forming an enlargement therein;

means for injecting gas into the at least one fuel feed channel, the gas being at a pressure PG that is greater than the pressure PA and greater than or equal to PC so as to create effervescence in the fuel on being introduced into the tubular structure;

at least one gas injection channel that opens out into the fuel feed channel(s) and that is connected to a gas feed duct; and an annular gas distribution cavity that is formed in the tubular structure around the fuel passage, that is connected to the gas feed duct, and that opens out into the gas injection channel.

2. An aerodynamic injection system for injecting an air/fuel mixture into a turbomachine combustion chamber, the system comprising:

a tubular structure of axis XX' that opens out at a downstream end for delivering the air/fuel mixture;

at least one air feed channel that is connected to a compressor stage of the turbomachine and that opens out into the tubular structure in such a manner as to introduce air at a pressure PA into the tubular structure;

an annular fuel passage that is formed in the tubular structure around its axis XX', that is connected to at least one fuel feed channel in which fuel flows at a pressure PC, and that opens out at a downstream end into the tubular structure, forming an enlargement therein;

means for injecting gas into the at least one fuel feed channel, the gas being at a pressure PG that is greater than the pressure PA and greater than or equal to PC so as to create effervescence in the fuel on being introduced into the tubular structure, wherein the air feed channel is disposed around the tubular structure and opens out axially into the fuel passage at an upstream end thereof.

3. A system according to claim 2, including at least one gas injection channel that opens out into the fuel feed channel(s) and that is connected to a gas feed duct.

4. A system according to claim 1, wherein the gas injection channel opens out substantially perpendicularly into the fuel feed channel(s).

5. A system according to claim 2, further comprising an annular gas distribution cavity that is formed in the tubular structure around the fuel passage, that is connected to the gas feed duct, and that opens out into the gas injection channel.

6. A system according to claim 1, further including an annular fuel distribution cavity that is formed in the tubular structure, that is connected to a fuel feed duct, and that opens out into the fuel feed channel.

7. A system according to claim 1, wherein the fuel feed channel(s) is/are inclined tangentially relative to the annular fuel passage.

8. A system according to claim 1, wherein the air feed channel opens out into the tubular structure at an upstream end thereof with the air being set into rotation.

9. A system according to claim 8, further including an outer air swirler that is disposed around the tubular structure, that is radially offset relative to the fuel passage, and that is designed to inject air into the outlet of the tubular structure in a direction that is substantially axial together with movement in rotation.

10. A system according to claim 8, wherein the outer air swirler is connected to a compressor stage of the turbomachine.

11. A system according to claim 8, further including a bowl forming a diverging portion mounted downstream from the tubular structure.

12. A system according to claim 2, wherein the annular fuel passage presents a narrowing of section in the fuel flow direction in order to accelerate the flow of fuel in the tubular structure.

13. A system according to claim 1, wherein the gas is air.

14. A system according to claim 13, wherein the air constituting the gas is taken after compression from a compressor stage of the turbomachine and prior to being further compressed.

15. A system according to claim 1, further comprising a device for controlling the flow rate of the gas injected into the fuel feed channel.

16. A turbomachine combustion chamber including an aerodynamic injection system for injecting an air/fuel mixture and in accordance with claim 1.

17. A turbomachine including a combustion chamber fitted with an aerodynamic injection system for injecting an air/fuel mixture and in accordance with claim 1.

* * * * *